US009492712B2

(12) United States Patent
Smith

(10) Patent No.: US 9,492,712 B2
(45) Date of Patent: Nov. 15, 2016

(54) SWIMMING PADDLE AND CUSTOM FITTING METHOD

(71) Applicant: Justin Pearson Smith, East Grand Rapids, MI (US)

(72) Inventor: Justin Pearson Smith, East Grand Rapids, MI (US)

( * ) Notice: Subject to any disclaimer, the term of this patent is extended or adjusted under 35 U.S.C. 154(b) by 428 days.

(21) Appl. No.: 13/897,976

(22) Filed: May 20, 2013

(65) Prior Publication Data

US 2013/0309922 A1 Nov. 21, 2013

Related U.S. Application Data

(60) Provisional application No. 61/648,810, filed on May 18, 2012.

(51) Int. Cl.
*A63B 31/10* (2006.01)
*A63B 31/04* (2006.01)
(Continued)

(52) U.S. Cl.
CPC ..... *A63B 31/04* (2013.01); *A63B 31/10* (2013.01); *A63B 71/0036* (2013.01); *A63B 33/00* (2013.01);
(Continued)

(58) Field of Classification Search
CPC ..... A63B 31/00; A63B 31/02; A63B 31/04; A63B 31/10; A63B 71/0036;
(Continued)

(56) References Cited

U.S. PATENT DOCUMENTS 2,810,138 A 10/1957 Cochran
4,832,643 A 5/1989 Schoofs
(Continued)

FOREIGN PATENT DOCUMENTS

CN 2179174 Y 10/1994
CN 2192356 Y 3/1995
(Continued)

OTHER PUBLICATIONS

In Su Yang, International Search Report, Sep. 17, 2013, 2 pages, Daejeon Metropolitan City, Republic of Korea.

*Primary Examiner* — Ajay Vasudeva
(74) *Attorney, Agent, or Firm* — McGarry Bair PC

(57) ABSTRACT

A swimming paddle with an upper rounded swimcap-shaped edge terminating in side indentations that define cap-securing temples, and a central goggle-securing notch cooperating with a concave region in the lower edge to store goggles vertically on the paddle. The paddle may further include fingerpad-indexing holes extending through the body of the paddle from the inner face to the outer face, the holes sized to allow only the fingerpads of a swimmer's extended fingers to partially protrude from the inner face. A method for custom fitting a swimming paddle to a particular swimmer's hand includes generating a side-by-side image of the swimmer's hand and a commonly-carried object such as a mobile phone in a common plane. The image is compared to stored dimensional data for the object to remotely determine the dimensions of the swimmer's hand and manufacture a custom paddle.

16 Claims, 10 Drawing Sheets

(51) Int. Cl.
*A63B 71/00* (2006.01)
*A63B 33/00* (2006.01)

(52) U.S. Cl.
CPC ..... *A63B 33/002* (2013.01); *A63B 2225/096* (2013.01); *A63B 2225/687* (2013.01)

(58) Field of Classification Search
CPC ..... A63B 2225/687; A63B 2225/096; A63B 33/002; A63B 33/00
USPC ..... 441/55–59; D21/807
See application file for complete search history.

(56) References Cited

U.S. PATENT DOCUMENTS

| | | | | |
|---|---|---|---|---|
| 4,913,418 | A | 4/1990 | Schlueter et al. | |
| 5,376,036 | A | 12/1994 | Hull | |
| D363,754 | S | 10/1995 | Johnson | |
| 5,511,998 | A * | 4/1996 | Johnson | A63B 31/10 441/56 |
| 5,516,319 | A | 5/1996 | Nessel | |
| 5,643,027 | A | 7/1997 | Evans et al. | |
| 5,651,710 | A | 7/1997 | Rives et al. | |
| 5,658,224 | A | 8/1997 | Betrock | |
| 6,183,396 | B1 | 2/2001 | Reynier | |
| D443,013 | S | 5/2001 | Chiang | |
| 6,226,795 | B1 | 5/2001 | Winningham | |
| 6,325,768 | B1 | 12/2001 | Williams et al. | |
| 7,179,146 | B2 * | 2/2007 | Johnson | A63B 31/10 441/56 |
| 7,194,327 | B2 | 3/2007 | Lam | |
| 7,267,595 | B1 | 9/2007 | Hall | |
| 7,346,421 | B2 | 3/2008 | Bijvoet | |
| 7,494,395 | B2 | 2/2009 | Krikliwy et al. | |
| D599,429 | S | 9/2009 | King et al. | |
| 8,321,301 | B2 | 11/2012 | Manea et al. | |
| 8,359,247 | B2 | 1/2013 | Vock | |
| 2003/0056384 | A1 | 3/2003 | Masley | |
| 2004/0203301 | A1 | 10/2004 | Johnson | |
| 2008/0214073 | A1 | 9/2008 | Krikliwy et al. | |
| 2008/0242167 | A1 | 10/2008 | Bolster | |
| 2012/0009833 | A1 | 1/2012 | Doyle | |
| 2012/0242815 | A1 | 9/2012 | Burgett et al. | |
| 2012/0287122 | A1 | 11/2012 | Nadar et al. | |
| 2013/0013447 | A1 | 1/2013 | Chityala et al. | |

FOREIGN PATENT DOCUMENTS

| | | | |
|---|---|---|---|
| CN | 2431909 | Y | 5/2001 |
| CN | 2863191 | Y | 1/2007 |
| CN | 201267696 | Y | 7/2009 |
| EP | 0323099 | A2 | 7/1989 |
| EP | 0801905 | A2 | 10/1997 |
| EP | 1351172 | A1 | 10/2003 |
| EP | 2388747 | A2 | 11/2011 |
| EP | 2458561 | A2 | 5/2012 |
| WO | 2005082467 | A1 | 9/2005 |
| WO | 2012048193 | A2 | 4/2012 |
| WO | 2013002440 | A1 | 1/2013 |

* cited by examiner

SWIMMING PADDLE AND CUSTOM FITTING METHOD

RELATED APPLICATIONS/PRIORITY BENEFIT CLAIM

This application claims the benefit of U.S. Provisional Application Ser. No. 61/648,810, filed May 18, 2012, which is incorporated herein in its entirety.

FIELD

The subject matter of this application relates to swimming paddles used by swimmers on their hands, and to methods of customization of swimming paddles and other article that are fitted to human hands or other parts of the human body.

BACKGROUND

Swimming paddles, also commonly known as "training paddles", "hand paddles", and "pulling paddles", are typically thin plates, frequently made of plastics, wood or similar material, with straps for holding the plates on the hands of swimmers during swim practice to enhance muscle build-up and speed. The paddles are relatively flat, often slightly concave, with rounded edges. The paddles also have straps on one side for securing them to the fingers and hand. They may also come in the form of a webbed glove, as described in "Interdigital webbed swimming glove" EP 2543417 A1.

The original swimming paddle is often attributed to Benjamin Franklin, and many designs have been invented over the years. Examples include those shown in U.S. Pat. No. 2,810,138 to Cochran (fitted to the back of the hand with knuckle indexing indentations); U.S. Pat. No. 5,651,710 to Rives et al (fitted to the front of the hand with a palm swell, and made from a transparent material); U.S. Pat. No. 5,516,319 to Nessel (hand-shaped planar paddle, with wrist extensions to keep the wrist stiff); and U.S. Pat. No. 4,913,418 to Schlueter et al (swim paddle with an approximately hand-sized pattern of apertures allowing water through to the swimmer's hand for better "feel" of the water, and an offset hand position placing the thumb closer to the edge of the paddle).

The paddles are typically sold in a single size although some manufactures may manufacture the paddles in a range of sizes, for example, small, medium and large to meet the size of the hands of swimmers. Swim paddles are essentially available in stock sizes and manufactured in mass and not custom made to order.

It is a well known fact that the paddle size is important, and that the ideal size is determined relative to the swimmer's hand. All paddles to date have come a limited number of size increments. "Size" may pertain to surface area of the paddle, or to the size of the swimmers hand, or to both. Typically, smaller paddles are designed for people with smaller hands, and larger paddles for larger hands. There are some paddles that have many holes enabling swimmers of many different hand sizes to arrange the strap to fit their hand, yet these paddles are also of the stock-size variety, and are "optimal" geometry for a certain sized hand. As swimmer's hands diverge from that optimal, comfort, fit and effectiveness are compromised. For example, a person who is pursuing competitive swimming may wish to begin with a smaller area paddle in order to avoid any muscle damage and build muscles over a period of time during of development of the athlete will have to use paddles that tend to be sized optimally for smaller hands at the beginning, and paddles ideal for larger hands as they progress. While this is feasible, and may be common practice due to lack of alternative, it is not ideal. It would be helpful to have a range of paddle sizes available for the same relative hand size. It would also be helpful to have paddles that have fingertip placement for proficient swimmers.

The paddle size may be defined (and/or defined) as a multiple or incremental value relative to the user's hand. It's important, because the relative size of the paddle is more critical (optimal) to the core functionality/purpose of the paddle than is the absolute size of the paddle. Naturally, the overall size of a human hand, and the lengths of each finger can vary significantly for each individual. The current sizing methods (i.e. S, M, L) could be misleading as they do not inherently incorporate the size, age, strength or other characteristic of the user. Using a paddle that is too big for a user could cause over-exertion or injury. Using a paddle that is too small might not achieve the intended training results for more aggressive users.

Although many prior types of swim paddle are known, none appears to be designed for efficient storage and transport with the other equipment normally carried by swimmers. None provides what might be considered to be an optimal "feel" for the water, and grip onto the paddle without compromising swimming efficiency. And none provides a truly convenient and cost-efficient way to custom-fit a paddle to a swimmer's hand.

BRIEF SUMMARY OF THE INVENTION

According to the invention, a pair swimming paddles, each of comprises a generally planar body, an outer face, an inner face with straps for releasably retaining a swimmer's hand to the paddle palm-side against the inner face, and upper, lower, and side perimetric edges; wherein a portion of the perimetric edge, typically an upper portion, defines a primarily convex rounded edge that generally conforms to the shape and size of a swim cap. The swim cap can be mounted to the pair of swimming paddles when placed together in facing relationship.

In one embodiment, pair the perimetric edges define at least one concave notch for mounting the straps of swim goggles, whose straps are mounted around the perimeter of the pair of swimming paddle when placed together in facing relationship.

Further, the at least one concave notch may be positioned in the upper perimetric edge and the lower perimetric edge may include a concave central portion in general vertical alignment with the at least one concave notch. It may also have protrusions to wrap the strap around, and notches to hold the strap in place.

In addition, each paddle may have fingerpad-indexing holes in the inner face communicating with the outer face. The fingerpad-indexing holes may be located to receive the fingerpads of a swimmer's extended fingers when the swimmer's hand is retained against the inner face of the paddle by the straps. The fingerpad-indexing holes may be sized to mount the frontal fingerpad portions of the fingertips within the fingerpad indexing holes and to protrude toward the outer face, with the fingerpads in contact with inner edges of the fingerpad-indexing holes.

The paddles further have hooking holes for hanging, holding, or strapping the paddles out of water. A protrusion may be formed on one or both of the paddles and a hooking hole may be in the protrusion for receiving a loop or strap for carrying the two paddles with or without the swim cap mounted thereto.

The paddles further may have surface area holes that are designed into the paddle to adjust the surface area as needed to compensate for the user's hand geometry, and/or other dimensional constraints of the paddle, such as the cap-holder or the protrusions.

In one embodiment, the paddles further may have smooth flow holes that prevent waffling effect when water flows through the paddles. Still further according to the invention, a method of custom making an article that is used in relation to a particular user's hand comprises creating a composite image of an object of known dimensions in adjacent juxtaposition to the user's hand in a common plane; transmitting the composite image to a remote location; and at the remote location, manufacturing the article based on the composite image to fit the user's hand.

The act of creating may include placing a commonly-carried, relatively flat handheld object of known dimensions and a user's hand or an image thereof in a common plane through which the object and hand can be imaged. In one embodiment, a bottle cap can be held between two fingers and a picture of the hand taken with fingers extended.

Typically, the composite is an electronic image for electronic transmission to a remote manufacturing source.

The act of manufacturing may include determining the dimensions of the hand by scaling the image of the hand relative to the known dimensions of the object of known dimensions. This approach may be used to determine (1) the overall size and surface area of the hand, and (2) the finger lengths, and distance from the pivot point in the palm to the finger tips. In addition, the act of manufacturing may also include storing two-dimensional dimension data for the common object of known dimensions.

In one embodiment, the method may be used to make a backpack and the may be the user's back in lieu of a hand. In another embodiment, a shoe or flip-flop may be made by imaging the user's foot along with a scalable object. In this case, the image may be an imprint of the user's foot in sand.

Still further according to the invention, a method for custom making a swimming paddle as described above wherein the user's hand is the user's hand, and the image is the user's hand place flat on a common plane with the object of known dimensions. In this process, the act of manufacturing may include determining the dimensions of the hand by scaling the image of the hand relative to the known dimensions of the object of known dimensions. The act of manufacturing may further include placing fingerpad-indexing holes the paddle to comport with the fingerpads of a swimmer's extended fingers when the swimmer's hand is retained against the inner face of the paddle by straps. In addition, the act of manufacturing can further include strategically placing holes in the paddle to reduce waffling of the paddles as water passes through and around the paddles in use. The act of manufacturing may also include computing the surface area of the user's hand and scaling the surface area of the paddle as a function of the area of the user's hand. In this respect holes may be strategically in the paddle to adjust the paddle square area to match the computed desired square area of the paddle. In so doing, the paddle can be designed such that the anticipated forces on the rigid paddle may sum to the same point on the swimmer's body as they would without the paddle. The magnitude, however, of the sum of these forces would be greater due to the increased surface area. This would best simulate the stroke of the swimmer as exerted on the arm and rest of the body. Using a traditional stock paddle is more prone to resulting "twisting" forces, requiring muscle strength in the arm to hold the paddle in the right way. These compensating efforts are a waste of the swimmer's energy, and may also be counter productive for technique training and muscle memory.

In another embodiment of the invention a method for custom-manufacturing a swimming paddle as described above may include placing an object of known dimensions and a swimmer's hand in a common plane through which the object and hand can be imaged; creating a composite image comprising side-by-side images of the commonly-carried object and the swimmer's hand in the common plane; and transmitting the composite image to a remote customizer or custom manufacturer. In this method, two-dimensional dimension data for a commonly-carried, relatively flat handheld object of known dimensions can be stored and compared to the image.

The fingerpad-indexing holes position the user's fingers consistently on the paddle, to feel the water through the paddle during a stroke, and to control the paddle via the inner edges of the holes.

In one embodiment, the fingerpad-indexing holes are formed in the paddle as part of a custom fitting process. It would not be possible to form the fingerpad-indexing holes in pre-set locations in traditional "stock" paddles, because knowledge of the length and position of the individual swimmer's fingers is required for proper placement of the holes on each paddle. For example, stock paddles having fingerpad-indexing holes in ranges of different sizes and locations could provide a satisfactory fit for most swimmers.

Still further according to the invention, a custom-fitting method for optimizing the size and contour of a paddle and the size and location of any fingerpad-indexing holes relative to a particular swimmer's hand comprises storing scalable dimensional information for a commonly-carried handheld object ("scalable object") such as a mobile phone, and receiving an image of the user's hand next to the image of the scalable object to determine the hand dimensions needed to custom fit a paddle. Typically, the process is carried out by a potential user who is remote from a custom design or manufacturing location. While the image-scaling method is advantageously used for generating data useful for custom fitting swimming paddles, it is within the scope of the invention to use this method for generating data useful for manufacturing or customizing other items that need to be fitted to a particular user's hand or feet.

Still further according to the invention, the customizing method described above can be used to custom make backpacks (dimensions across shoulder blades and to the load bearing part of the lower back), shoes and flip flops (sizing for these can also be obtained by taking a picture of the common scalable object next to a footprint in the sand which serves as a foot-mold), Computer Mice, Sporting goods that have handles such as tennis rackets, Helmets, sunglasses, gloves, clothes, wetsuits, and other sporting goods. In some cases a combination of front view and profile view may be used in combination.

The method further includes creating an image of a user's hand (or other body part such as feet) next to the common scalable object, and transmitting the scaled image to a manufacturer. The method further includes designing and manufacturing a paddle according to the hand dimensions determined from the scaled image. The image can come from a capture device such as a photocopier with a scanning function that creates an image that can be sent, preferably by electronic communication to a manufacturer. The scanner can also be a digital camera, a phone with a digital camera, and a laptop with a scanning function or a laptop with a built-in web camera installed above the screens of a computer. By angling the screen down, the camera can capture from the top side the dimensions of a human hand or other item. Knowing the dimensional geometry of the computer (based on model number), basic trigonometry could be used to calculate the scale and dimensional information of the hand. The customer would have to abut the tip of their finger to the base of the laptop.

A further feature of the invention is to scale the overall size of the paddle in accordance to the size of the swimmers hand. Most swimming paddles come in S, M, L sizes. But a person with a capture medium may double the surface area of one person's hand, and triple it for another's. Having the detailed geometry of the swimmer's hand (thru the methods described), the natural surface area of the scanned hand can be computed and the paddle can be designed as a function of the natural surface area of the scanned hand. For example, if the surface area of the hand is X, the surface area of the paddle can be some function of X, for example, Psa=f(X), where Psa is the surface area of the paddle, and f(X) is the equation for the surface area of the paddle. The equation can be linear or a geometric. For example, the surface area of the paddle and be a multiple of the surface area the hand in whole of fractional integers, for example, 2, 2.5, 3, . . . n. The same swimmer may order increasing size paddles with the same hand print over a period of time as swimming proficiency increases. The invention provides a system and method for more appropriate sizing of the paddle, which may help in avoiding injury or overstressing arms inappropriately. It also provides a method and system for swimmers to progress to larger paddles as their strength grows, or as they adopt different training routines. It may also enable coaches to prescribe a training routine to an entire team based on 2× paddles (Paddles 2 times the surface area of the users hand) and the effect would be the same for all swimmers. Currently, a coach could say "use a medium paddle", but a medium paddle might be 1.5× for a large-hand swimmer and 3× for a small-hand swimmer. He could clarify to use a "medium paddle for your hand" but there is still a lot of room for different interpretations. It may also enable limitations of paddle size for children, whose hands and shoulders are still in development. It can also be useful for physical training.

The capture devices or scanners that are used in this invention are distinguished from body scanners—like at airports, and others that are emerging for sizing apparel. Such devices and apparatus are specifically designed for measuring the size of the body. Those might be in a retail location where customers would have to go to "Get Scanned". The capture device and the common scaling object may be limited to common, household devices and objects. The ideal examples for this method may be a bottle cap and a cell phone camera.

These and other features and advantages of the invention will become apparent from the detailed description below, in light of the accompanying drawings.

DETAILED DESCRIPTION

Figure 1:
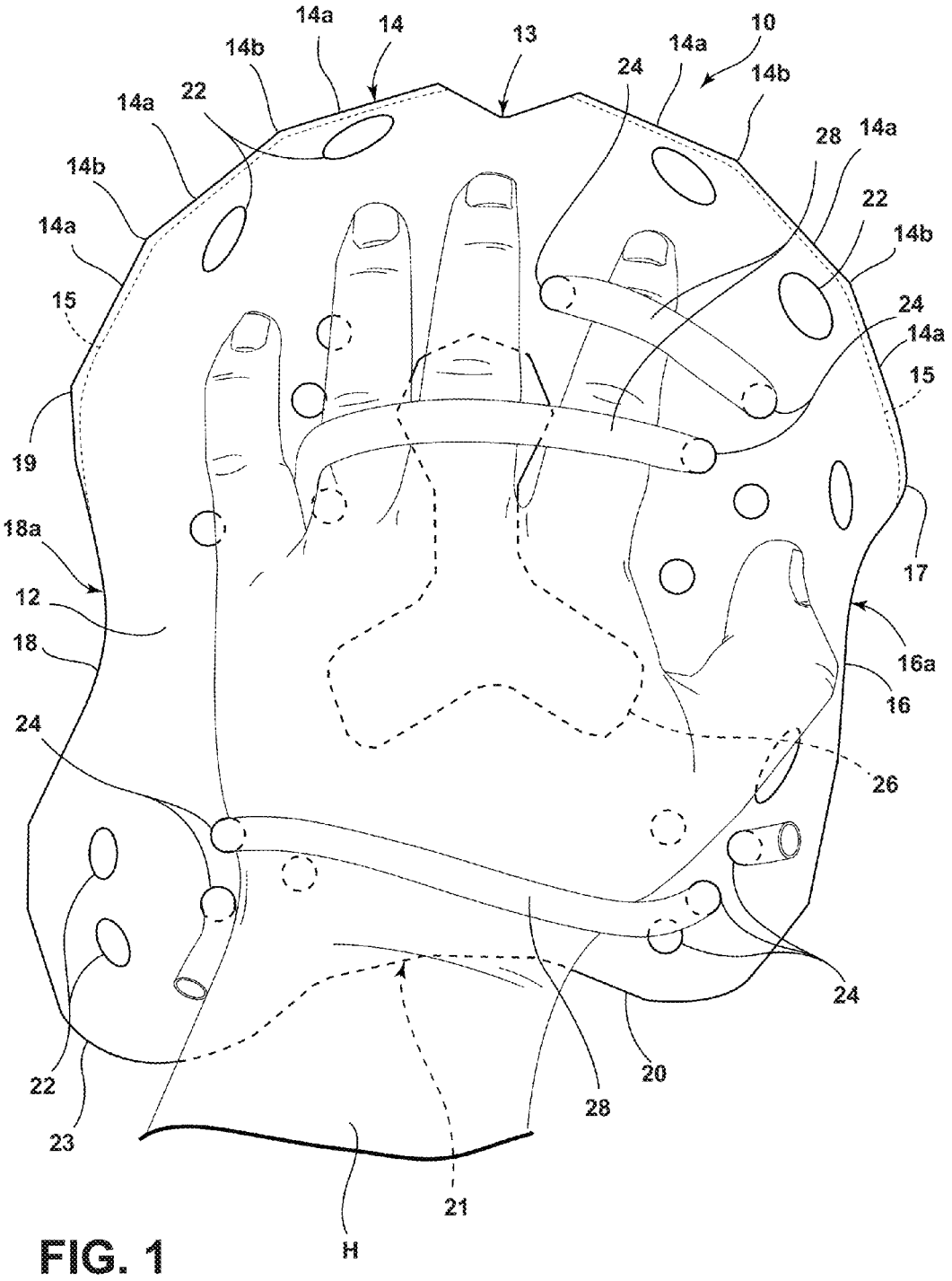
FIG. 1 is a plan view of an inner face of an exemplary paddle according to the invention.

Referring first to FIG. 1, a swimming paddle 10 is shown in exemplary and currently preferred form in order to teach how to make and use the claimed invention. Paddle 10 has a generally planar body made from a plastic, wood or any other suitable material, such as but not limited to, acrylic or polypropylene. Paddle 10 has an inner face 12 against which a swimmer's hand H is secured, palm-down, by elastic or other types of strap 28. Various strap-securing holes 24 are shown formed through the body of the paddle to thread or knot or otherwise secure elastomeric straps 28 in various patterns that can be customized by the swimmer. The type and number of elastomeric straps and the locations of strap-securing holes 24 may vary.

Paddle 10 has an upper edge 14 defining over its length a generally semi-circular "head" region 15 that approximates the size and contour of a swimmer's head sufficiently to enable a swim cap to be applied in tension for storage. Head region 15 terminates in outermost "temples" 17 and 19 defined between upper edge 14 and side edges 16 and 18 by concave side regions or indentations 16*a* and 18*a*. Temples 17 and 19 are accordingly the widest part of the head region 15, protuberances that flare outwardly relative to the adjacent side edge regions 16*a* and 18*a*. The temples define anchor points below which the brim of a swim cap can be secured, the temples stretching the adjacent portion of the swim cap above the brim to lock it in place.

Figure 2:
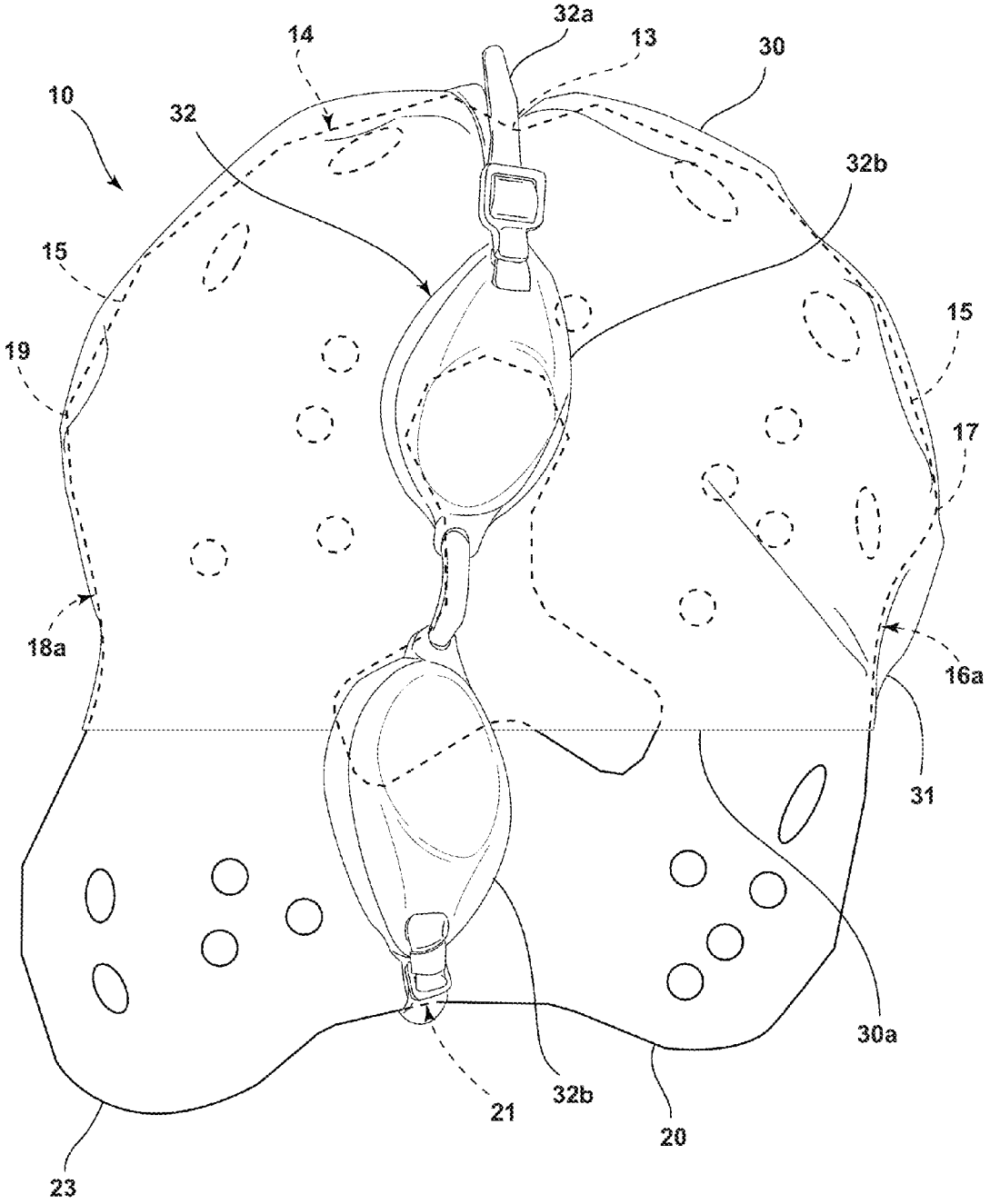
FIG. 2 is similar to FIG. 1, but shows a swim cap and goggles stored on the paddle.

FIG. 2 shows paddle 10 with the swimmer's hand and the elastic straps 28 removed, and a cap 30 secured to paddle 10 by stretching it over head region 15 and around temples 17 and 19. The brim 31 of cap 30 extends horizontally across the body of paddle 10 approximately between the indented side regions 16*a* and 18*a*. Because of the elasticity of the typical swim cap and the flexibility of the straps 28, it is usually not be necessary to remove the straps before storing a swim cap on the paddle. In addition, a swim suit can usually be fitted into the cap to make a nice neat package for transport to and from the pool. It may be conveniently carried without a gym bag, or clipped to the outside of a gym bag which may be preferable for these items likely to be wet. Holes 22 at the bottom of the paddle can be used for a carry strap that can be clipped to a bike or similar transport article. The entire bundle may also be strapped securely to a an athletes waist or lower back (additional strap is not shown) to conveniently run home from the pool.

In the illustrated example of paddle 10, upper edge 14 presents an overall rounded contour approximating the curvature of a head or a swim cap, even though the overall curvature.

Paddle 10 further includes a goggle storage notch 13 formed centrally in upper edge 14, sized to receive and locate the elastic strap on a pair of swim goggles. Paddle 10 has a lower edge 20, preferably concave along a concave lower edge region 21 in a central portion to provide clearance for the swimmer's wrist to bend, and to supplement the goggle storage notch (or curved indentation) 13 located vertically above it. To fit a larger goggle elastic size, there may be two protrusions on the lower ends of the paddle to wrap the strap around snugly (not shown). FIG. 2 shows a pair of goggles 32 stored vertically on paddle 10, with elastic strap 32*a* stretched between notch 13 and concave lower edge region 21, in a preferred orientation with eyecups 32*b* flat against the face of the paddle. It is preferred to store goggles 32 along the vertical axis of paddle 10, between upper edge 14 and lower edge 20, because the top-to-bottom dimensions of paddle 10 will generally be greater than the side-to-side dimensions of the paddle, minimizing the need to adjust the goggles' strap length to achieve a suitable storage tension when applied to the paddle.

FIGS. 1 and 2 also show lesser features of the paddle 10, including an array of water-admitting peripheral apertures 22 formed around the edges of the paddle; a generally Y-shaped palm opening 26 sized and shaped to funnel water through the valley and against the pads of a swimmer's palm during swimming; and a "horn" extension 23 located at the outer lower corner of the paddle adjacent the exterior side of the swimmer's wrist, at the junction between lower edge 20 and outer side edge 18. The opening 26 lies below the part of a hand that would not make contact with the surface of the paddle.

Figure 3:
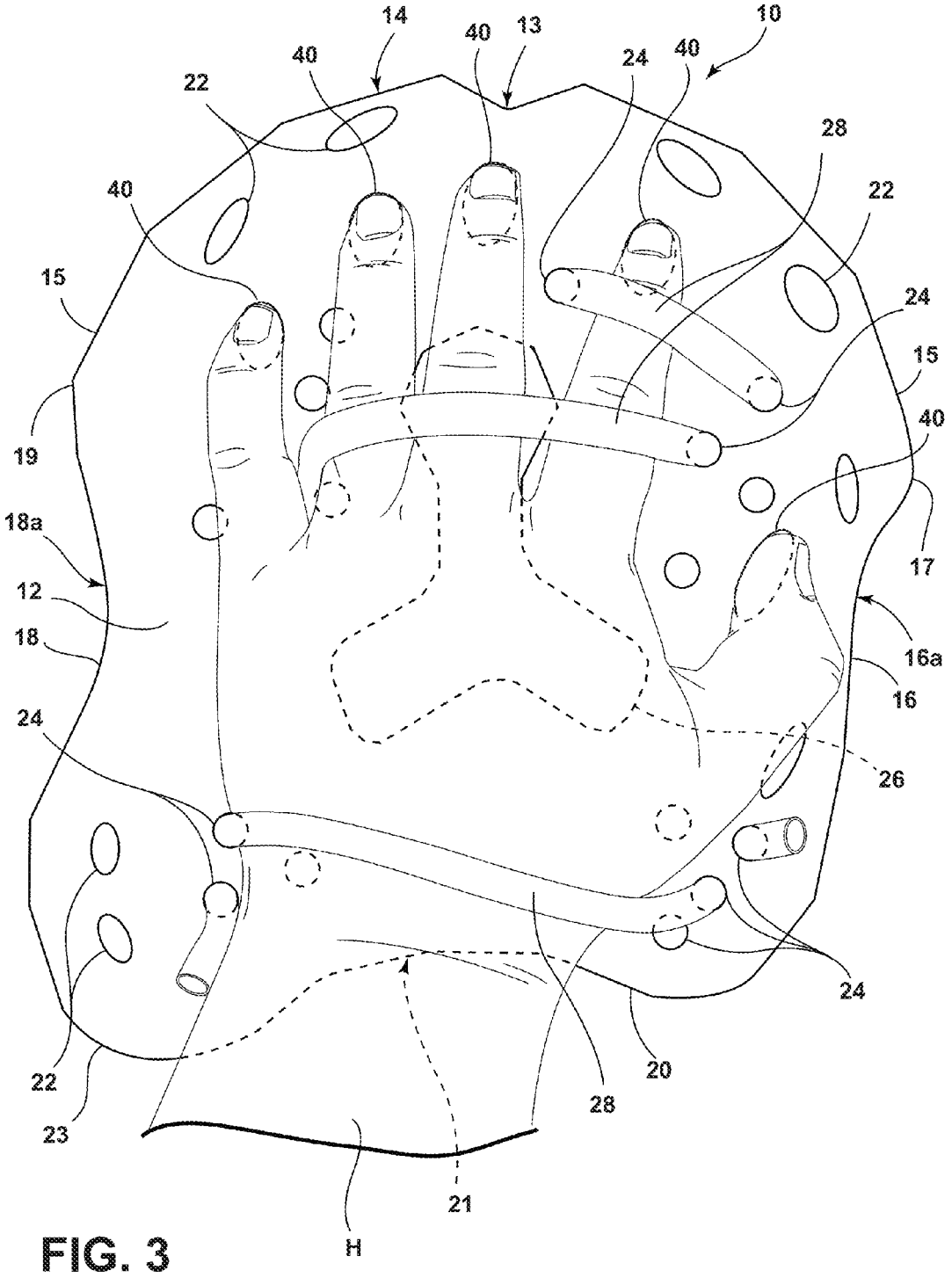
FIG. 3 is similar to FIG. 1, but shows fingerpad-indexing holes formed through the paddle.
Figure 4:
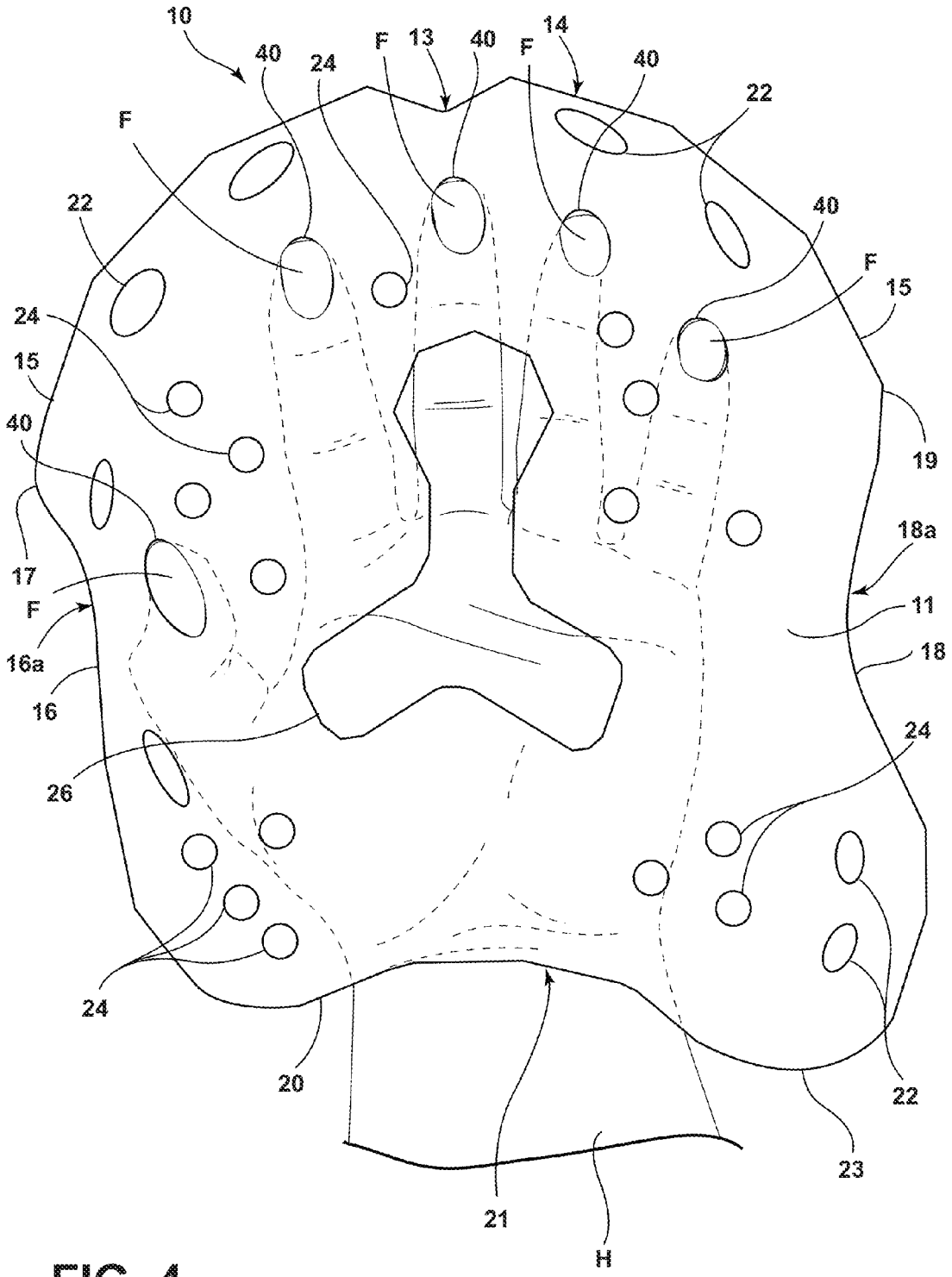
FIG. 4 is a plan view of the outer face of the paddle of FIG. 3, showing a swimmer's finger pads through the fingerpad-indexing holes.
Figure 5:
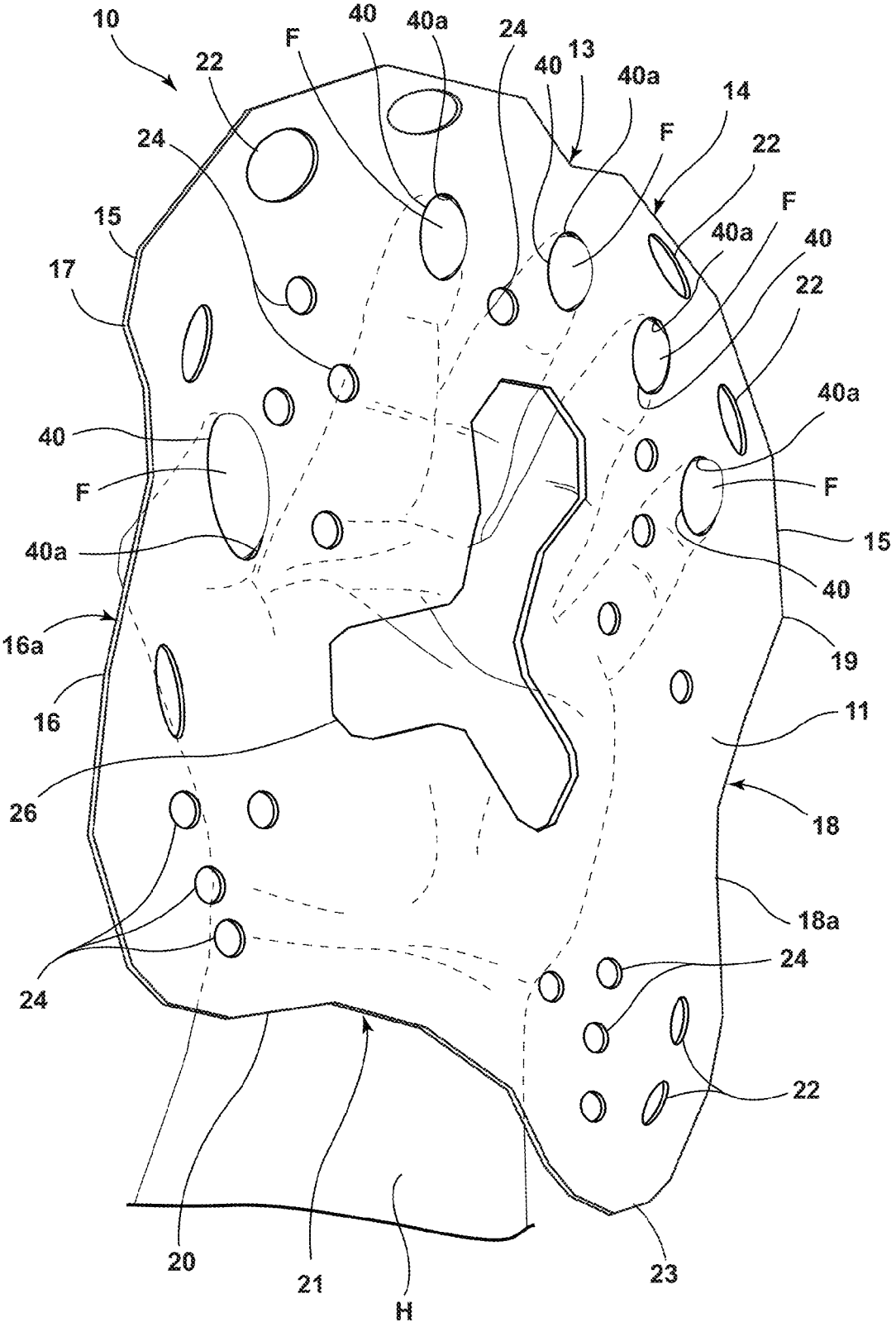
FIG. 5 is a perspective view of the outer face of the paddle of FIG. 3, with the swimmer's fingerpads protruding through the fingerpad-indexing holes.

Referring next to FIGS. 3 through 5, paddle 10 is shown with optional fingerpad-indexing holes 40, located to receive the pads F at the tip of the swimmer's extended fingers and thumb. Holes 40 may be mere indentations if intended only to locate/index the fingertips, but in the illustrated embodiment the holes 40 extend completely through the body of paddle 10. These are holes that go all the way through provide passages for the water to pass through the paddle so that the user will get the "feel" of the water on the finger tips.

Fingerpad-indexing holes 40 are sized and shaped to be smaller and narrower than the fingertips, and smaller than the full area of the front-facing fingerpad portions of the fingertips, so that only a portion of the fingerpads F are exposed from the inner face of the paddle, "bubbling" through the holes to the outer side of the paddle adjacent the paddle's outer face 11. The fingerpad-indexing holes 40 are sized so that the fingertips themselves (the first joint of the fingers, or "distal phalanges") cannot extend through holes 40. The fingerpad-indexing holes 40 are placed and sized so that the pad of the fingertip "bubbles" down into the hole and at the peak of the bubble is roughly flush with the water-side of the paddle 10. The function of the fingerpad-indexing holes 40 is to provide a custom fit and grip (while keeping fingers straight) and giving a user the feel of the water (or water flow/pressure) thru the paddles. Typically, the size of the indexing holes 40 is generally in the range of 50%-95% of the finger tip contact area based on the scan, or in the case of the generic or stock paddle, in the range of 0.25 to 0.6 inches wide and 0.75 to 1.25 long (in the direction of the finger).

The degree to which the fingerpads F will protrude or bubble through the holes 40 toward the outer side of the paddle can vary, depending on the thickness of the paddle body, but in general it is preferred that the fingerpad-indexing holes 40 do not allow the fingerpads to protrude beyond the outer face 11 of paddle 10. Fingerpads F preferably remain recessed within the holes, below the plane of the outer face 11.

Holes 40 also provide an extra degree of control over paddle 10 when the fingerpads are indexed therein. When holes 40 extend through the body of the paddle, the primary contact between the fingertips and the paddle is via the holes' inner edges 40*a*, while the fingerpads remain free to feel the water and provide feedback.

It will be appreciated that the best fit between fingerpad-indexing holes 40 and fingerpads F for a particular swimmer is achieved with a custom fitting and manufacture of paddle 10, in particular with respect to locating and sizing holes 40. However, where it is impractical to manufacture a custom paddle for every swimmer, it would be possible to provide stock paddles 10 without fingerpad-indexing holes 40 and to custom-form the fingerpad-indexing holes after locating or measuring a swimmer's hand on the stock paddle.

Figure 8:
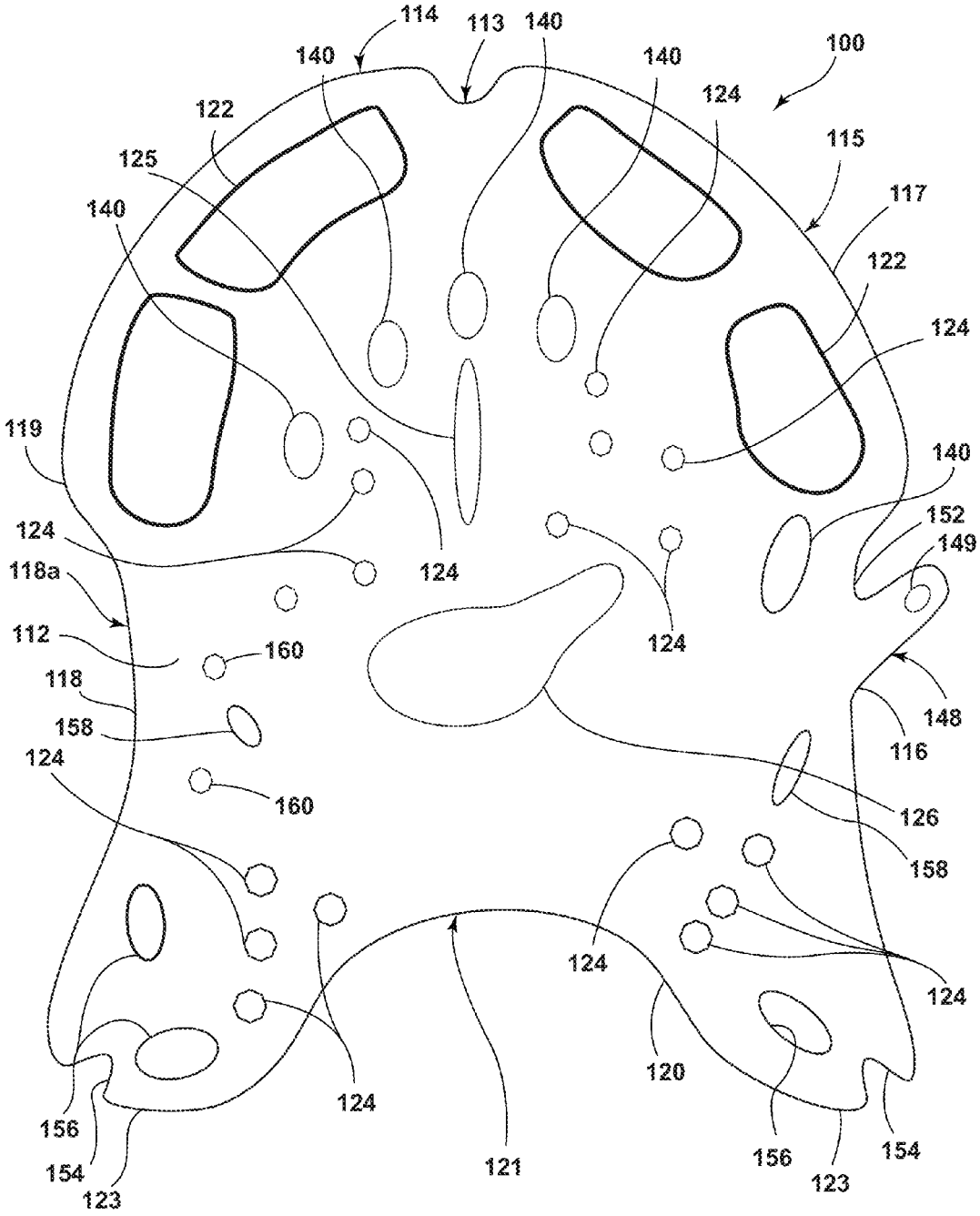
FIG. 8 is a plan view, like FIG. 1 of a second embodiment of the invention, but without the hand and strap. This Figure shows the hanging protrusion, 3 notches for the goggles, and "surface area" holes to achieve a specific surface area while maintaining the proper form for the swim cap holder.

Referring now to FIG. 8, a modified form of the paddle according to the invention is show. It is similar to the paddle illustrated in FIGS. 1-5, but with a slightly different profile and hole pattern. In FIG. 8, like numbers increased by 100 have been used to designate like parts. In FIG. 8, the head region 115 is more rounded and the flat edges in this region have been removed. In addition, the surface area apertures 122 in the head region have been enlarged. The size of\these apertures can be varied to adjust the desired surface area of the paddle as is described below. Extensions 123 extend from both sides of the paddle and each contains a notch 154 for positioning a goggle strap 32*a* (FIG. 2) and a hooking hole 156 for receipt of a strap for suspending the paddles from a support for carrying the composite package of the paddles, the swim cap, the goggles and swim suit. The central area of the paddles has a vertical opening 125 and oblong shape 126 which function as feel holes for the swimmer's hand as water passes through them. Further the thumb side of the paddle has a projection 148, forming a notch 152 for the strap of a swim cap and a hooking hole 149 for attaching a strap for carrying the package of the paddles, the swim cap, the goggles and swim suit. In addition, 160 holes are provided for possible attachment of functional parts that may include electronic measuring instruments.

Where, however, it is desired to have a paddle custom-fitted or custom-manufactured, with respect to the paddle as a whole or with respect to the locations of the fingerpad-indexing and other holes formed in the paddle, the custom paddle can be formed in accordance with a method for making a custom paddle when the user and the manufacturer are remote from one another. While it is possible to have custom paddles 10 made locally for local swimmers, based on direct, in-person hand measurements, the remote method is useful and efficient for those swimmers who lack such a local custom paddle manufacturer. Actually, a picture/scan is much better than hand measurement, even if it is possible to do a hand measurement in person.

Figure 6:
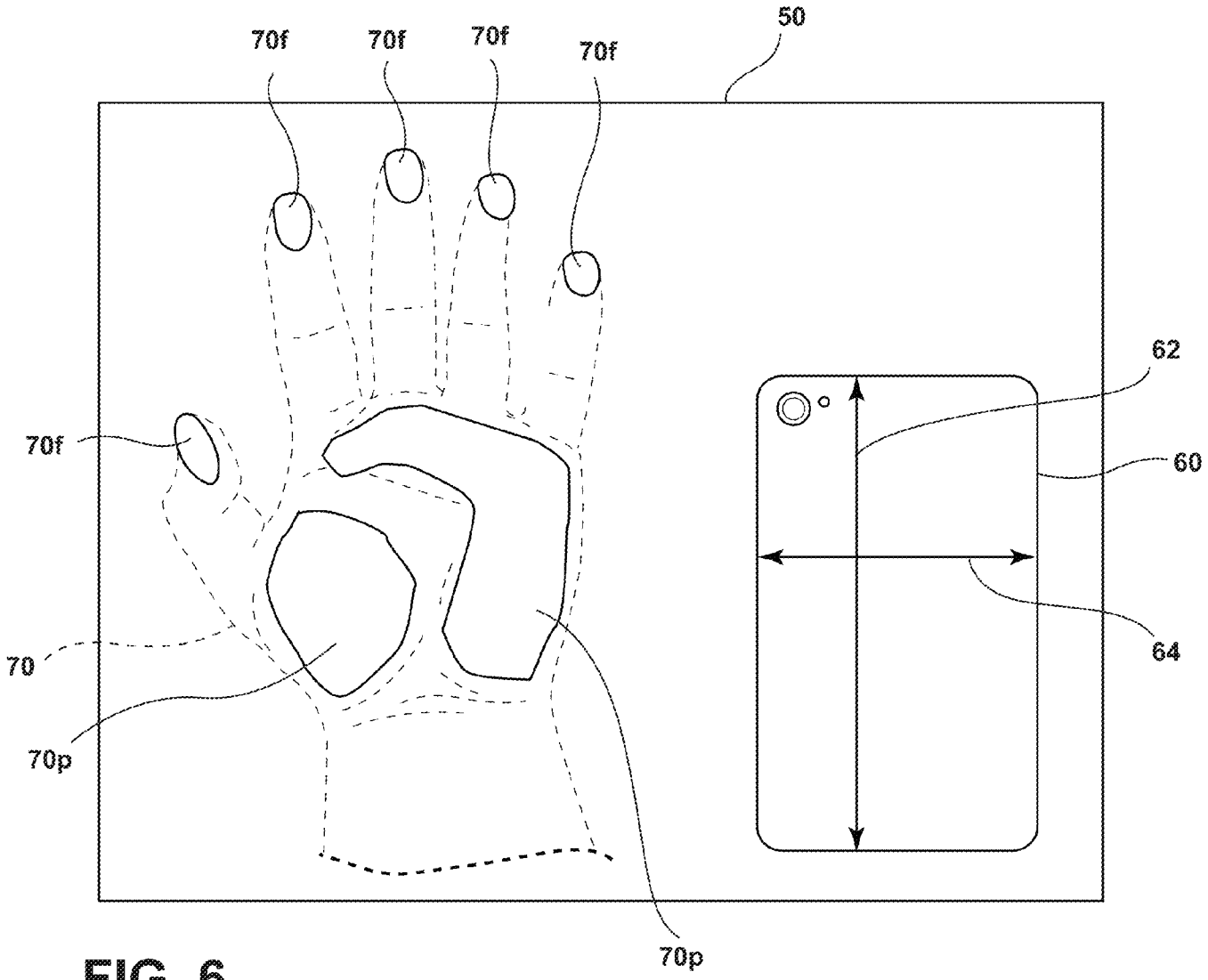
FIG. 6 is a schematic of a scanner bed with a swimmer's hand and a scalable handheld object next to each other for scale, and also of a transmittable composite image produced thereby.

FIG. 6 is a schematic representation of an image scanning device, for example a common flatbed scanner capable of producing a storable, transmittable electronic image of relatively flat objects placed on the scanning bed. In this illustrated example of the method, a swimmer places his or her hand on the flatbed, relatively flat with fingers extended in a relaxed swimming position and palm-down. A scalable, commonly-carried, relatively flat handheld object, such as a mobile phone 60 or a ruler, is placed on the scanning surface next to the hand so that both hand and phone are scanned at the same time, producing a composite image comprising both the hand and the phone located on a common, planar surface in the same image.

The phone is described as "scalable", meaning that it is an item with relatively fixed, standard/universal, known dimensions (for example, length 62 and width 64), the item having at least one sufficiently flat surface or side capable of being imaged clearly enough to be used as a scale-indicating control next to a human hand in the same plane. By comparing the known dimensions of the phone to the image of the adjacent hand, the two-dimensional dimensions of the hand can be determined with sufficient accuracy to size and shape a paddle 10 using ordinary skill in the art of swimming paddle manufacture, and to size and locate fingerpad-indexing holes 40 and other features such as palm opening 26, strap-securing holes 28, straps and other features.

While a mobile phone is currently the preferred and illustrated example of a scalable object, other commonly carried, relatively flat, handheld objects of known, scannable dimensions could be used such as a dollar bill, a coin, a bottle cap or a Coke can.

Figure 9:
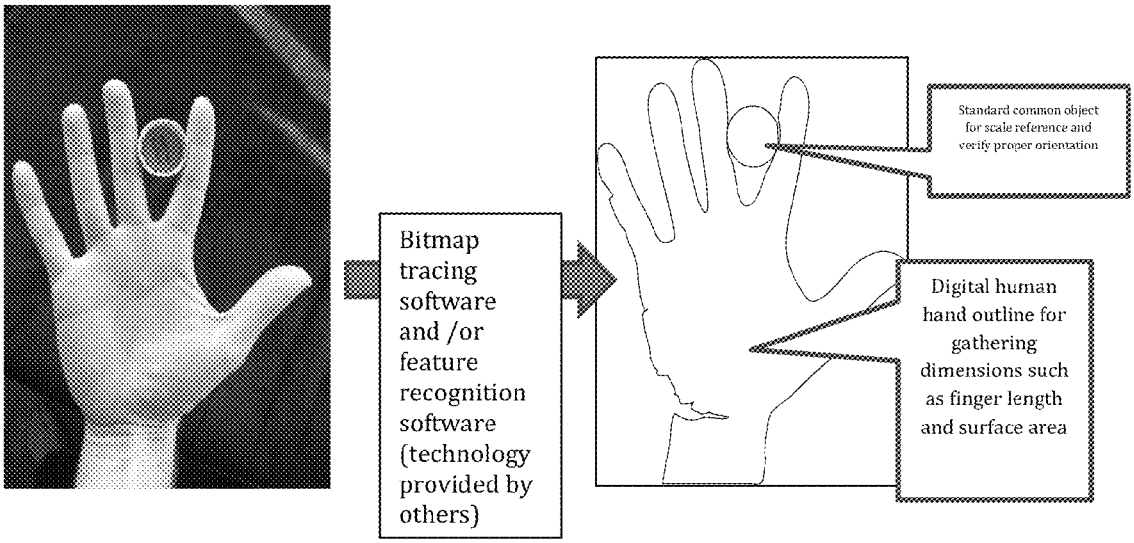
FIG. 9 is an illustration of a hand print with a bottle cap and the digital image produced by computer recognition.

FIG. 6 should also be understood to represent a composite image 50 produced by the image-generating method described above, the composite image comprising the image of a hand 70 and the image of a scalable object (mobile phone 60) in a common plane. While the illustrated image represents an electronically scanned image, it should be understood that non-scanned images are also possible, including film and electronic photographs of a hand next to a phone. For example, a swimmer could hold a common scalable object such as a bottle cap between two fingers and take a picture of the hand held flat. See FIG. 9. The (known) diameter of the lower rim of the bottle cap is used to establish a scale for the hand dimensions and geometric shape (i.e., finger lengths). The "roundness" of the circle may also verify the degree of the picture, as 90 degrees is ideal. It may also help to compute corrections.

As mentioned above, an imprint on another medium such as wet sand on the beach may also serve as sizing data capture surface.

FIG. 6 also shows certain portions of hand 70 highlighted in solid lines, namely fingerpads 70*f* and palm swells or pads 70*p*, as the portions pressed flat against the scanning bed or imaging surface, and thus coplanar with phone 60. It will be understood that not all of hand 70 need be in the same plane as phone 60 when the image is generated, as long as the portions of the hand critical to custom fitting and manufacture are coplanar with the phone 60.

Figure 7:
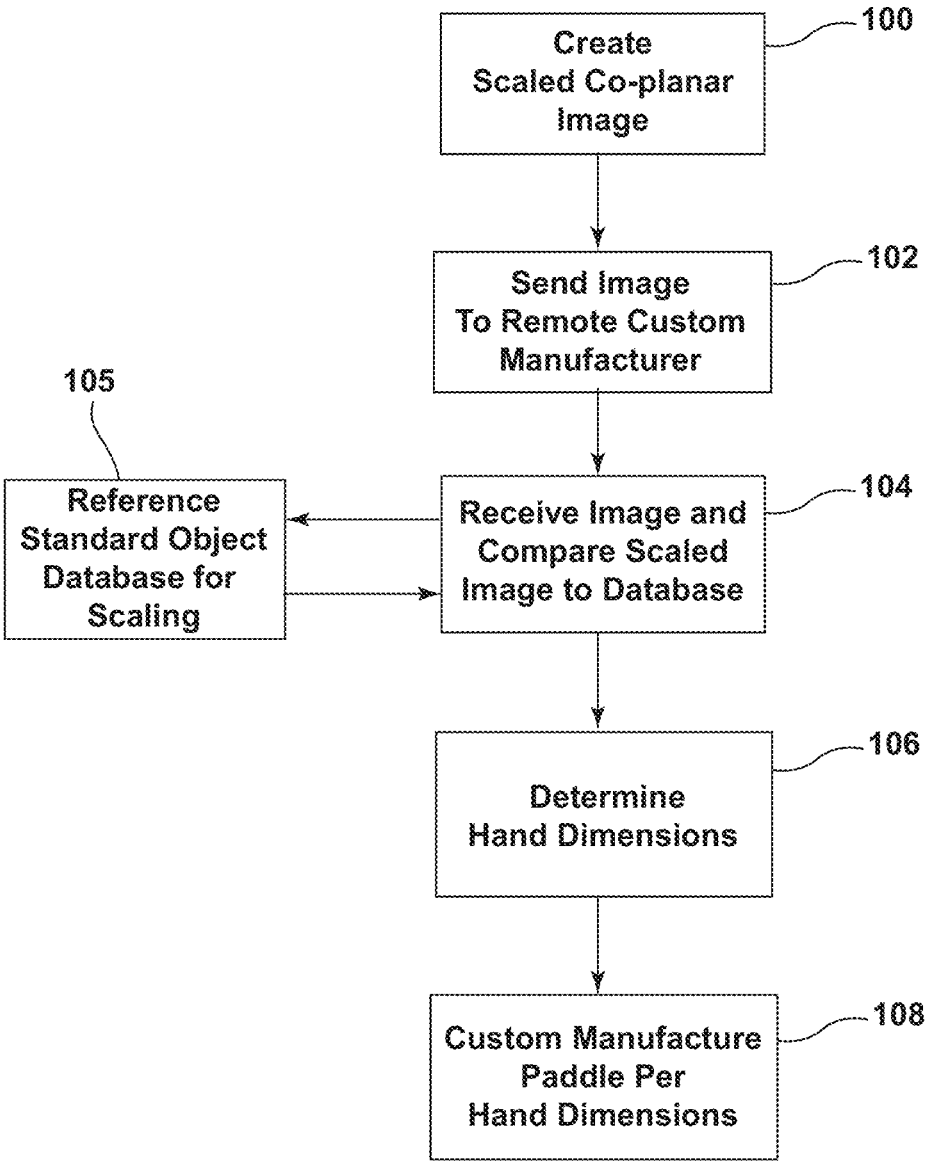
FIG. 7 is a schematic representation of a method according to an embodiment of the invention where a scalable image such as shown in FIG. 6 is used to manufacture a custom swimming paddle.

FIG. 7 schematically illustrates the above-described methods for generating a composite image 50 suitable for remote use to manufacture a custom paddle 10, and for remotely using such a composite image 50 in the custom-fitting or manufacture of a paddle 10. In addition, the swimmer/customer's name can be printed or engraved into the paddle for identification, as well as numerical dimensions defining the individual hole pattern, or reference code thereof. These markings could be used for replacements, or additional products fitting the same user.

At 100 a swimmer or someone helping the swimmer creates a scaled, coplanar, composite image such as 50 shown in FIG. 6, for example, using the flatbed scanning method of FIG. 6. At 102 the image 50 is sent to a remote custom manufacturer, by any known physical or electronic method for transmitting an image—for example, mail, email, fax, or upload to a computer network through the Internet, without limitation.

At 104 the remote custom fitter or manufacturer receives the previously-generated image 50, and compares it to or consults a database 105 containing the dimensions of the scalable object, such as mobile phone 60 of a particular make and model which is also communicated with the sizing data.

The nature and structure of the database 105 can vary, from a printed list of a single scalable object's dimensions in a desk drawer, to dimension data for dozens or hundreds of scalable objects in an electronic file or database on a computer or computer network's memory or storage facility. Likewise, the manner of comparing the scaled image to the database may vary, from a human finding the dimensions for the imaged object on a printed list of dimension data, to automated or computerized retrieval of object dimension data from the database based on an electronic or optical comparison of data in image 50.

At 106, the dimensions of the swimmer's hand are determined based on the known dimensions of the scalable object from database 105. The manner of determining can be as simple as a visual measurement using a ruler or similar physical measuring device against the composite image, or as sophisticated as automated, computer-driven optical comparisons. Any known method or technology for determining the two-dimensional size of a first object from the known dimensions of a second object visually related thereto should be possible. In addition, the square area of the hand print can be calculated from the image after the image scaled as a measure of the potential normal resistance of the hand in swimming without a paddle.

At 108, the determined dimensions of the swimmer's imaged hand are used to manufacture a custom paddle, or to customize a pre-manufactured "stock" paddle, for example by locating and forming fingerpad-indexing holes 40. With the dimensions of the swimmer's hand known, it is believed that those skilled in the art of swimming paddle manufacture will be capable of manufacturing and/or custom-finishing a paddle 10 as illustrated in FIGS. 1 through 5.

The custom manufacture procedure in 108 can include a number of process steps. The square area of the paddles can be manufactured a function of the swimmer's hand profile square area which can be calculated in 106. For example, the swimmer may be a beginner, a developing or a proficient swimmer. Each of these categories of swimmers may require different size paddles for what might the same relative size of the hand. For example, a swimmer may progress from a beginner, an intermediate or developing swimmer to a proficient swimmer over the period of a year. The swimmer begins with a first custom paddle that has an effective resistance area (area within the perimeter of paddle minus holes) of 2X, where X is the computed square area of the swimmer's hand. As the swimmer progresses, he or she may wish to have a paddle with more resistance for more effect training and order a paddle with more effective resistance area, for example, 2.5X for 3X. As the swimmer advances to another level he or she may want another paddle with yet more effective resistance area. The increased effective resistance area paddle can be easily made by the manufacturer by merely increasing the effective resistance area of the former paddle by adjusting the size of the surface area holes and/or increasing the perimetrical size of the paddle. The finger holes may also serve as a verification that the paddle is in fact the approximate multiple of the surface area of the swimmer's hand. For younger swimmers whose hands are still growing, they will feel that the holes don't fit as their hand grows, and this will deter use of a paddle whose relative surface area/size is not known. (and therefore possible mis-use, or uninformed/unintended use of the paddle)

Figure 10:
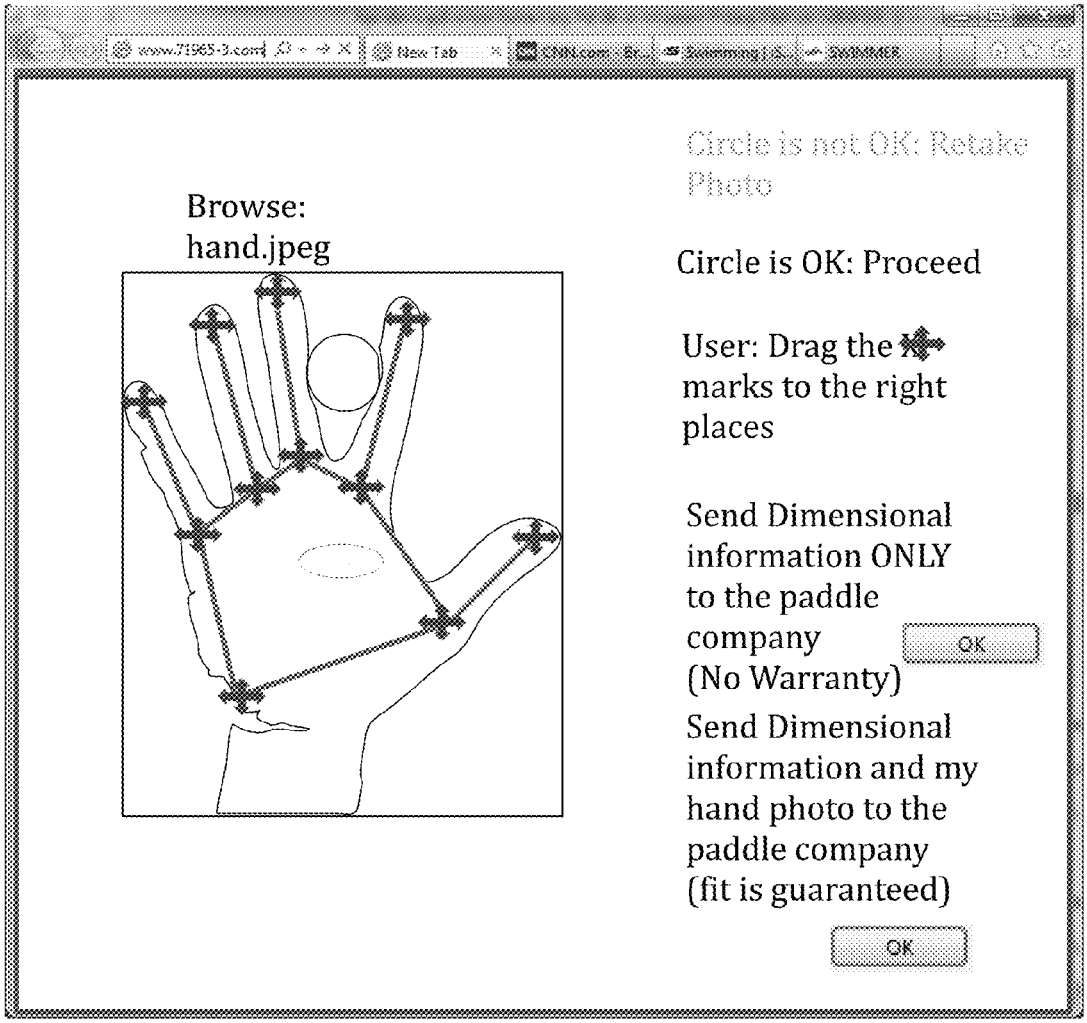
FIG. 10 is a schematic drawing of a parametric digital hand outline that can be employed in a modified method according to the invention.

The square area of the hand can be calculated in a number of know digital modeling techniques in design. For example, as the diameter (or other dimension of the scaling object) is known, the dimensions of the other objects in the image (i.e. the hand) are known relative to the scalar object in a common plane. Any, if not all digital design/CAD environments have their own defined scale. Adjusting the image size so that the scalar object is to be the correct size in the digital world will set the other geometry to be the right scale as well. As illustrated, use a bit-map tracing software or algorithm (in this case Adobe illustrator, but there are many many others) which finds edges based on color contrasts of pixels in a picture. The hand is then represented by a "closed loop"—the area is calculated by: using squares or known geometry to approximate the hand, and calculating/adding up the area of the squares. Coloring the inside of the closed loop (green for example) and counting the number of green pixels (this is actually a variation on the latter) and mathematical calculations based upon the vector equations defining the path of the hand outline. It can be manually traced or a parametric digital hand outline can be manually (but still in the digital world) adjusted to align with the image. Additional approximation of the hand geometry could be done by the user or the manufacturer by placing identifier points on the picture as a background. See FIG. 10.

The manufacturing technique envisioned is to use CNC laser cutting and/or 3D printing. These are tools that manufacture one-by-one based on a set of digital instructions (known as G codes). This is in contrast to injection molding and other traditional mass manufacturing parts. However, the final clear fins product might employ a combination of components made by any process (i.e., the elastic tubing is stock, or there could be a stock farm into which a custom-manufactured piece that fits.

The surface area/square area of the paddle is a function of two things:

1. the outer profile (perimeter) of the paddle including any protrusions or lever arms Minus (−)

2. The sum of the holes (voids) inside (bounded by) the outer profile of the paddle.

While some parts edges of the profile will be fixed (constrained) to accommodate the appropriate geometry of the paddle (i.e. where the wrist is, optimal flow considerations, swim cap edge, etc), other dimensions may be adjusted manually or automatically to achieve the right surface area and balance pressure loading/flow. Holes in the paddle are defended and adjusted in the same way (parametrically) to optimize for the intended surface area and design considerations specified.

The flow of water through and around the paddle can be simulated using a CFD (Computational Fluid Dynamics) software or algorithm (well established) and this analysis/results can be used (manually or automatically) to figure out the best dimensions which parametrically define the geometry previously described.

It will be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention supported by the above disclosure should accordingly be construed within the scope of what it teaches and suggests to those skilled in the art, and within the scope of any claims that the above disclosure supports in this provisional application or in any non-provisional application claiming priority to this provisional application.

The invention claimed is:

1. A pair swimming paddles, each of which comprises:

a generally planar body having an outer face, an inner face, an upper perimetric edge, a lower perimetric edge, and side perimetric edges;

a retainer for releasably retaining a swimmer's hand to the paddle palm-side against the inner face;

a plurality of elongated holes disposed proximal to the upper perimetric edge, wherein the longer dimensions of the elongated holes are substantially parallel to the upper perimetric edge; and a plurality of fingerpad-indexing holes in the inner face of the planar body, the fingerpad-indexing holes sized to receive one of the frontal fingerpad portions of the fingertips of the swimmer's hand, when the swimmer's hand is retained against the inner face of the paddle by the retainer;

wherein each of the side perimetric edges is tapered inwardly such that top and bottom portions of the planar body are broader than a middle portion of the planar body defined by the tapered portions of the side perimetric edges.

2. The pair of swimming paddles of claim 1, wherein the upper perimetric edge defines a primarily convex, rounded edge that generally conforms to the shape and size of a swim cap, whereby the swim cap can be mounted to the pair of swimming paddles when placed together in facing relationship.

3. The pair of swimming paddles of claim 2 wherein the retainer comprises straps, and wherein the perimetric edges define at least one concave notch for mounting swim goggle straps around the perimeter of the pair of swimming paddles when placed together in facing relationship.

4. The pair of swimming paddles of claim 3, where the at least one concave notch is positioned in the upper perimetric edge and wherein the lower perimetric edge includes a concave central portion in general vertical alignment with the at least one concave notch.

5. The pair of swimming paddles of claim 2 and further comprising a protrusion on one or both of the paddles and a hooking hole in the protrusion for receiving a loop or strap for carrying the two paddles.

6. The pair of swimming paddles of claim 1 wherein the paddles further have hooking holes for hanging, holding, or strapping the paddles out of water.

7. The pair of swimming paddles of claim 1 wherein the plurality of elongated holes are disposed distally of the plurality of fingerpad-indexing holes.

8. The pair of swimming paddles of claim 1 wherein one of the plurality of fingerpad-indexing holes is disposed proximally to the tapered portion of one of the side perimetric edges and the remaining plurality of fingerpad-indexing holes are disposed on the broader top portion of the body.

9. The pair of swimming paddles of claim 8 wherein the remaining plurality of fingerpad-indexing holes are disposed substantially equidistant from the upper perimetric edge.

10. The pair of swimming paddles of claim 1 wherein the plurality of fingerpad-indexing holes comprise five fingerpad-indexing holes.

11. The pair of swimming paddles of claim 1 wherein the bottom portion of the body comprises two spaced lobes separated by a concave central portion, with the lobes and central portion defining the lower perimetric edge.

12. The pair of swimming paddles of claim 11 wherein one of the lobes is larger than the other of the lobes to define a lowermost portion of the lower perimetric edge.

13. The pair of swimming paddles of claim 1 wherein the body further comprises a generally Y-shaped palm opening.

14. The pair of swimming paddles of claim 1 wherein the inner face of the planar body defines a customized paddle surface area defined by a measurement of an individual swimmer designated for use of the pair of swimming paddles.

15. The pair of swimming paddles of claim 14 wherein the fingerpad-indexing holes are located on the inner face based upon the measurement of the individual swimmer.

16. The pair of swimming paddles of claim 1 wherein the fingerpad-indexing holes extend completely through the planar body.

* * * * *